US005453025A

United States Patent [19]

Wilson

[11] Patent Number: 5,453,025

[45] Date of Patent: Sep. 26, 1995

[54] ELECTRICAL CONNECTOR

[75] Inventor: Ronald A. Wilson, Medway, Mass.

[73] Assignee: Redev Management Corp., Melvin Village, N.H.

[21] Appl. No.: 201,261

[22] Filed: Feb. 24, 1994

[51] Int. Cl.[6] ..... H01R 9/05

[52] U.S. Cl. ..... 439/578

[58] Field of Search ..... 439/578–585, 439/675, 98, 99, 741, 751, 873, 733

[56] References Cited

U.S. PATENT DOCUMENTS

| | | | |
|---|---|---|---|
| 2,590,761 | 3/1952 | Edgar . | |
| 2,984,811 | 5/1961 | Hennessey, Jr. et al. . | |
| 3,107,950 | 10/1963 | Kleven . | |
| 3,150,231 | 9/1964 | Clark . | |
| 3,292,117 | 12/1966 | Bryant et al. . | |
| 3,297,978 | 1/1967 | Stark | 439/585 |
| 3,311,431 | 3/1967 | Hilliard . | |
| 3,323,098 | 5/1967 | O'Keefe et al. | 439/585 |
| 3,336,563 | 8/1967 | Hyslop . | |
| 3,359,047 | 12/1967 | Andersen . | |
| 3,390,374 | 6/1968 | Forney, Jr. | 439/585 |
| 3,409,864 | 11/1968 | Hoffman . | |
| 3,577,496 | 5/1971 | Hoffman . | |
| 3,670,293 | 6/1972 | Garver | 439/585 |
| 3,678,447 | 7/1972 | Ziegler, Jr. et al. . | |
| 3,758,916 | 9/1973 | Wetmore . | |
| 4,110,716 | 8/1978 | Nikitas . | |
| 4,135,776 | 1/1979 | Ailawadhi et al. | 439/585 |
| 4,360,245 | 11/1982 | Nikitas . | |
| 4,412,717 | 11/1983 | Monroe . | |
| 4,556,271 | 12/1985 | Hubbard . | |
| 4,619,496 | 10/1986 | Forney, Jr. et al. | 439/585 |
| 4,688,877 | 8/1987 | Dreyer . | |
| 4,775,325 | 10/1988 | Wilson . | |
| 4,799,902 | 1/1989 | Laudig et al. . | |
| 4,907,983 | 3/1990 | Wilson . | |
| 4,920,643 | 5/1990 | Wilson . | |
| 4,971,578 | 11/1990 | Wilson . | |
| 5,115,563 | 5/1992 | Wilson . | |

OTHER PUBLICATIONS

Prior use if knurled inner conductor as described in accompanying statement.

Specification sheet for AEP captivation SMA receptacles and adapters.

*Primary Examiner*—David L. Pirlot

*Attorney, Agent, or Firm*—Wolf, Greenfield & Sacks

[57] ABSTRACT

An electrical connector is provided that includes an outer conductor having a generally smooth inner surface defining a bore extending through at least a portion of its length, an insulator being partially disposed within the outer conductor bore and having its own bore extending through at least a portion of its length, and an inner conductor disposed at least partially within the insulator bore. The outer conductor includes at least one protrusion extending from its generally smooth inner surface, the at least one protrusion engaging the insulator to inhibit relative rotational movement between the insulator and the outer conductor. A method is also provided for creating the protrusions and includes the steps of providing a staking tool having at least one stake corresponding to a desired position for the at least one protrusion, and driving the staking tool into the outer conductor so that the at least one stake displaces some material of the outer conductor to form the at least one protrusion.

47 Claims, 7 Drawing Sheets

ELECTRICAL CONNECTOR

FIELD OF THE INVENTION

The present invention relates generally to an electrical connector, which may be of the jack-to-jack or barrel connector type, having an inner conductor, an outer conductor and an insulator disposed therebetween.

BACKGROUND DISCUSSION AND OBJECTS OF THE INVENTION

An example of a known electrical connector construction is described in U.S. Pat. Nos. 4,907,983 and 5,115,563 (hereafter respectively "the '983 patent" and "the '563 patent"), which are incorporated herein by reference. FIG. 1 illustrates the components of this known electrical connector, which include an inner conductor 3, an outer conductor 5, and an insulator 7. The outer conductor 5 is provided with a central bore 9 that is defined in part by an inwardly directed substantially annular ridge 2 which defines the minimum diameter of the bore. The insulator 7 is provided with a substantially annular recess 6 along its outer surface. Additionally, the insulator also has a central bore 4 extending through its length, A method of assembling the connector components is described in the '563 patent. Initially, the insulator 7 is inserted into the outer conductor bore 9 until the insulator recess 6 aligns with the annular ridge 2. When the insulator 7 is in an unstressed state, its maximum diameter is greater than the minimum diameter of the outer conductor bore 9. However, when passed through the annular ridge 2 during insertion, the insulator 7 is radially compressed to a smaller diameter. After the insulator 7 is positioned within the outer conductor, the inner conductor 3 is inserted into the insulator bore 4. The insertion of the inner conductor radially expands the insulator 7 and assists in moving it back to its unstressed configuration, and into solid engagement with the walls defining the outer conductor bore 9. Thus, the connector assumes its assembled configuration as shown in FIG. 2. The above described method of assembly is advantageous because it does not require the use of any additional binding materials or the application of heat.

As described in the '983 patent, the connector 1 is characterized by having an improved mechanically tight seal so that the inner conductor 3 and outer conductor 5 maintain a rigid mechanical interconnecting relationship over a wide temperature range. This advantage is obtained by the interlocking engagement between the annular ridge 2 of the outer conductor 5 and the insulator's annular recess 6.

Although the above-described connector has been found to work effectively in many applications, it does not include any means for preventing rotation of the inner conductor 3 relative to the insulator 7, or of the insulator relative to the outer conductor 5. Thus, this connector may not satisfy some military specifications which require that the connector withstand specified amounts of torque applied to its components without altering the relative rotational positions of the inner and outer conductors. For example, some military specifications for electrical connectors require that the device withstand the application of up to four ounce-inches of torque to the inner conductor 3. Furthermore, it is also desirable to prevent relative rotation of the connector components for connectors used on printed circuit (PC) boards. When a connector is used on a PC board, one end is typically soldered to a connection on the board, and an electrical component is screwed into a mating relationship with the free end of the connector. If the inner and outer conductors are free to rotate relative to each other, the action of screwing a component into the free end of the connector may cause the fixed end to rotate and break the solder connection.

Several techniques have been developed for preventing relative rotation between the components of an electrical connector. An example of such a technique uses an epoxy pin to engage each of the connector components. Initially, one or more holes are provided in the inner and outer conductors, as well as the insulator. An epoxy is injected into the holes to form a pin that engages each of the connector components and prevents them from rotating relative to one another. Although this technique is effective in preventing relative rotation, it has several disadvantages. First, electrical leakage tends to occur at the holes provided in the inner and outer conductors, thereby reducing the performance of the connector. Second, it is difficult to provide an epoxy pin that has a uniform configuration as it extends through the outer conductor, insulator, and inner conductor, and as a result, the electrical characteristics of the connector may vary depending on the exact configuration of the epoxy pin. Third, the epoxy is messy and may undesirably contaminate other electrical components, possibly interrupting proper electrical contact and requiring disassembly of the connector. Finally, this technique typically involves several time-consuming steps, including allowing the connector to sit for a long period of time so that the epoxy has ample time to set properly.

Accordingly, it is an object of the present invention to provide an improved electrical connector having an improved mechanism for preventing relative rotation of its components.

SUMMARY OF THE INVENTION

The foregoing problems are solved by one illustrative embodiment of the present invention wherein an electrical connector is provided that includes an outer conductor having a bore extending through at least a portion of its length and a generally smooth inner surface defining the bore, an insulator having a bore extending through at least a portion of its length, the insulator being at least partially disposed within the outer conductor bore, and an inner conductor disposed at least partially within the insulator bore. In accordance with the invention, the outer conductor includes at least one protrusion extending from its generally smooth inner surface, the at least one protrusion engaging the insulator to inhibit relative rotational movement between the insulator and the outer conductor.

In another illustrative embodiment, a method is provided for creating at least one protrusion on a first component of an electrical connector, the first protrusion for preventing relative rotational movement between the first component and a second component of the electrical connector, the first component having a bore passing through at least a portion of its length, with the second component being disposed at least partially within the bore. In accordance with the invention, the method includes the steps of providing a staking tool having at least one stake corresponding to a desired position for the at least one protrusion, and driving the staking tool into the first component so that the at least one stake displaces some material of the first component to form the at least one protrusion.

In a further illustrative embodiment, a method is provided for assembling an electrical connector that includes an outer conductor, an inner conductor and an insulator, the insulator having a bore extending through at least a portion of its length. In accordance with the invention, the method includes the steps of forming a bore through at least a portion of the outer conductor, driving a staking tool into engagement with the outer conductor to form at least one protrusion from the outer conductor that reduces the diameter of the bore, inserting the insulator into the outer conductor bore, and inserting the inner conductor into the insulator bore.

BRIEF DESCRIPTION OF THE DRAWINGS

Numerous other objects, features and advantages of the invention should now become apparent upon a reading of the following taken in conjunction with the accompanying drawings, in which.

DETAILED DESCRIPTION

Figure 1:
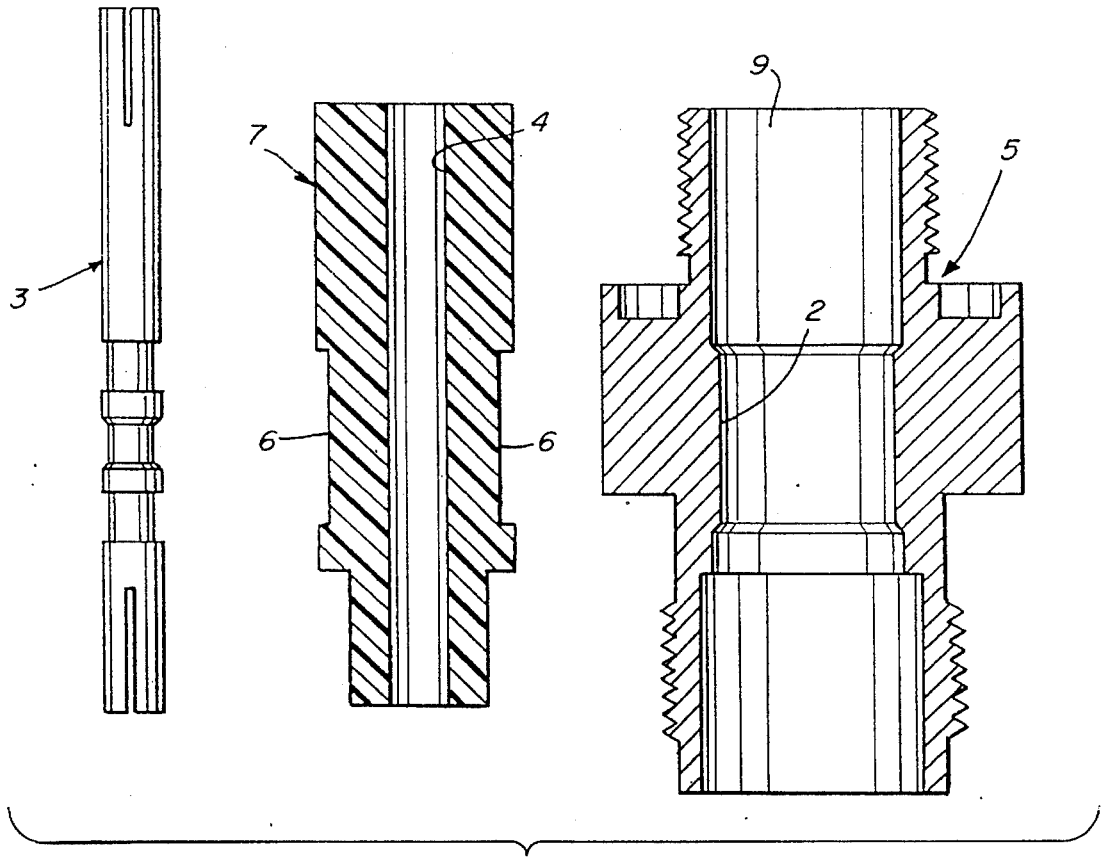
Fig. 1 (PRIOR ART)
FIG. 1 illustrates the components of a prior art connector.
Figure 2:
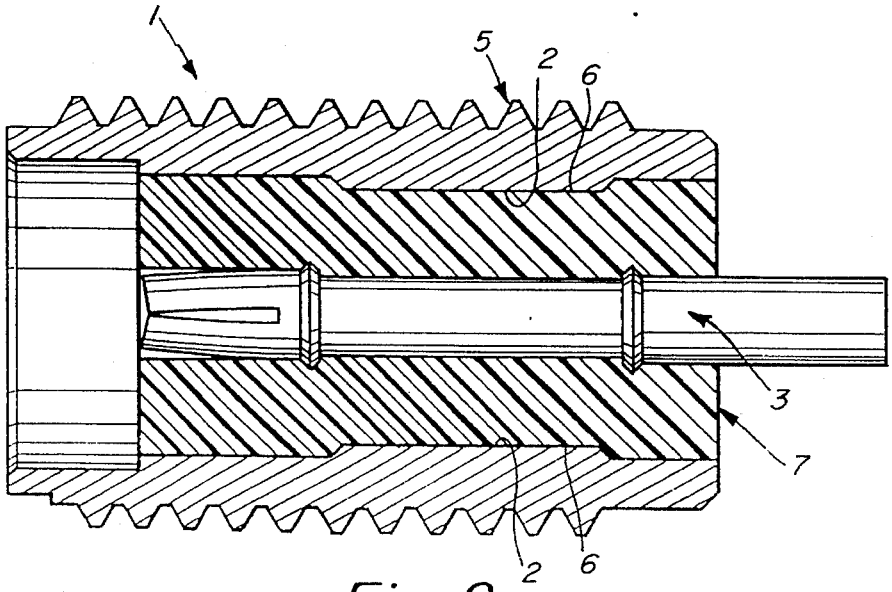
Fig. 2 (PRIOR ART)
FIG. 2 is a longitudinal cross-sectional view of the connector of FIG. 1 as assembled.
Figure 3:
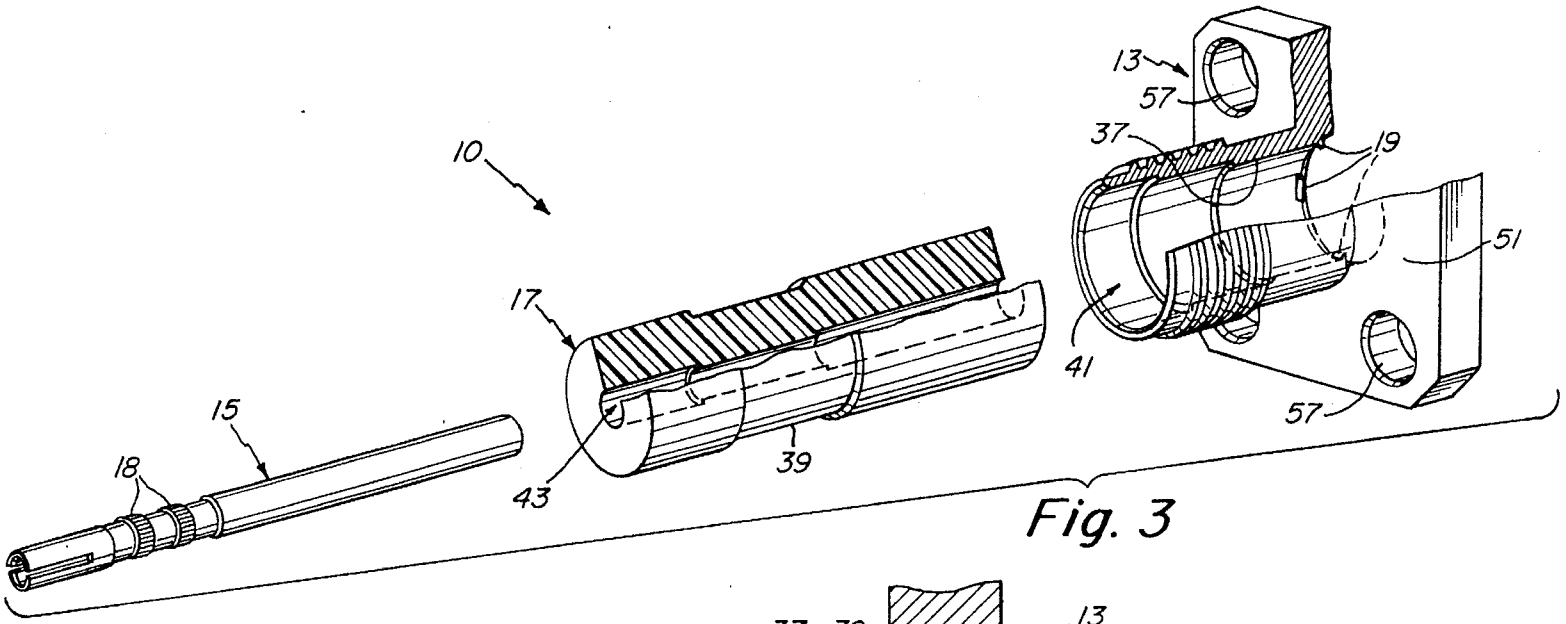
FIG. 3 is an exploded view of a connector of the present invention.
Figure 4:
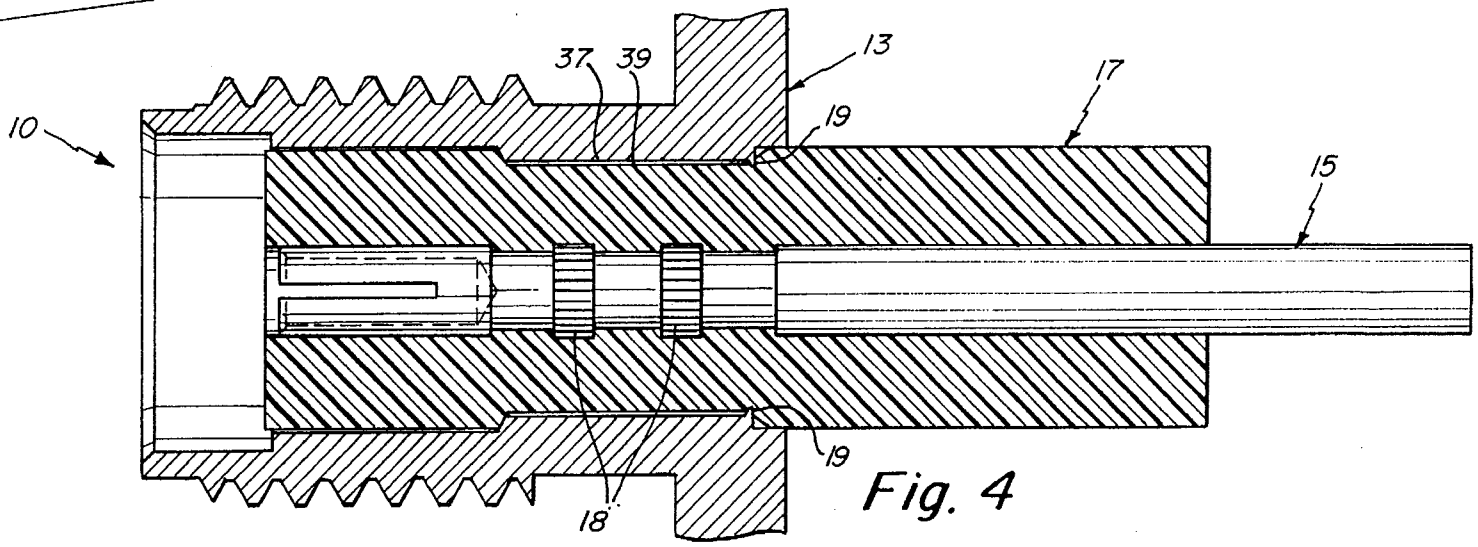
FIG. 4 is a longitudinal cross-sectional view of an assembled connector of the present invention.

In accordance with the present invention, an improved electrical connector construction is provided, as well as a method of assembling the improved connector. An illustrative embodiment of an electrical connector 10 of the present invention is shown in FIGS. 3 and 4, in which FIG. 3 is an exploded view and FIG. 4 is a longitudinal cross-sectional view of the assembled connector. As seen from FIGS. 3–4, the connector 10 is similar in some respects to the above-described prior art connector, in that it includes an outer conductor 13 having a central bore 41, an insulator 17 disposed within the bore 41 and having its own central bore 43, and an inner conductor 15 disposed within the bore 43. However, unlike the prior art device, the connector 10 also includes means for preventing the inner conductor from rotating relative to the insulator, and means for preventing the insulator from rotating relative to the outer conductor.

Figure 5:
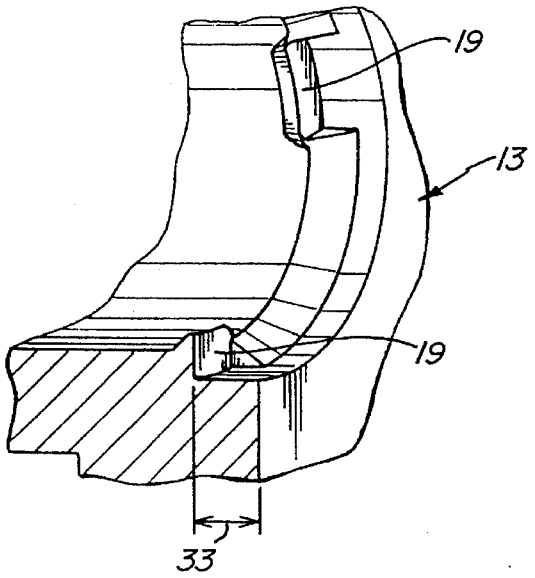
FIG. 5 is a partial perspective view of the staked end of the outer conductor.
Figure 6:
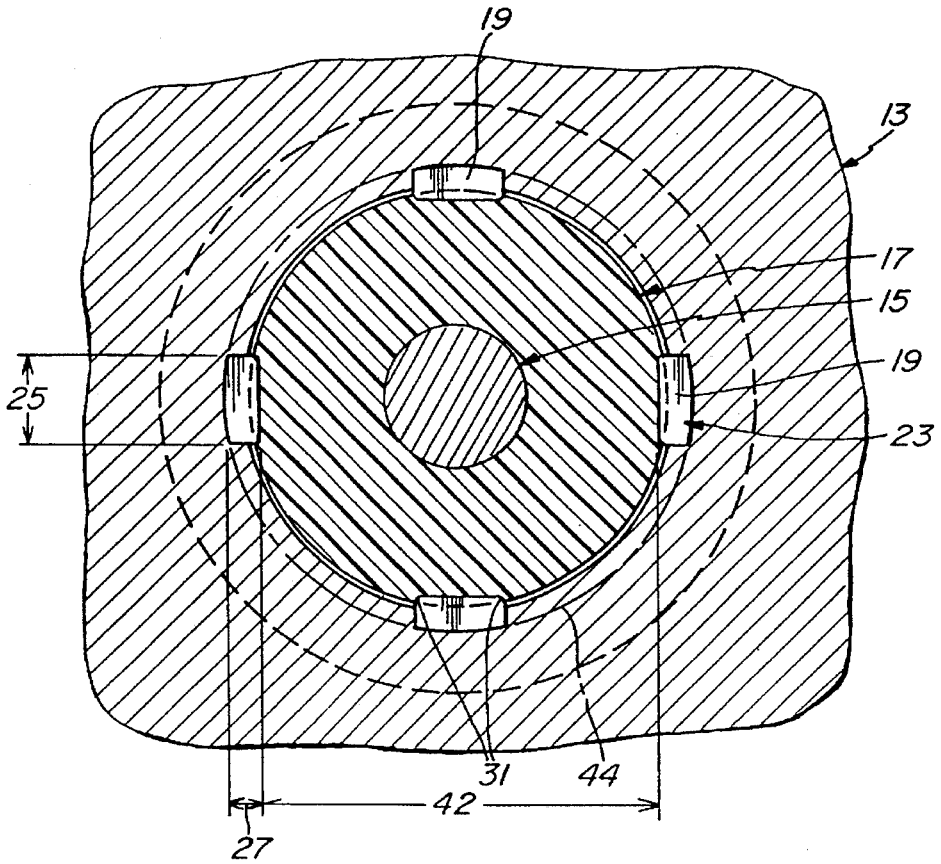
FIG. 6 is cross-sectional view of an assembled connector of the present invention showing the engagement of the outer conductor protrusions with the insulator.
Figure 7:
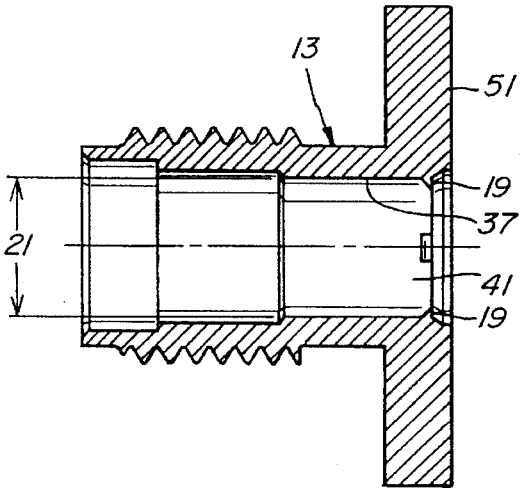
FIG. 7 is a longitudinal cross-sectional view of an outer conductor of the present invention.

The outer connector 13 is provided with a plurality of protrusions 19, each of which extends from the otherwise smooth surface of the outer conductor defining the bore 41. The protrusions 19 are shown in more detail in FIGS. 5–6, in which FIG. 5 is a perspective view of the end of the outer conductor on which the protrusions are disposed, and FIG. 6 is a cross-sectional view of the assembled connector taken across its width. The improved connector 10 of the present invention is assembled using a method, similar to that described in the '563 patent mentioned above, wherein the insulator 17 is initially inserted into the outer conductor bore 41, and the inner conductor 15 is then inserted into the insulator bore 43. As seen from FIGS. 4 and 6, the protrusions 19 extend sharply from the otherwise smooth surface of the outer conductor along the bore 41, and engage the insulator 17.

The outer conductor 13 is formed of a material having greater strength than the insulator 17 material. In a preferred embodiment, the insulator 17 is formed of Teflon® (i.e., polytetrafluoroethylene) and the outer conductor 13 is formed of stainless steel. The Teflon® insulator 17 has good shape memory so that it tends to revert back to its normal unstressed position after it has been deformed, As a result, when the insulator 17 is being inserted into the outer conductor 13, the protrusions 19 extend into the insulator material, but the Teflon deforms, allowing the insulator 17 to pass by the protrusions 19. Once the insulator 17 is in the fully inserted position shown in FIG. 4, the portions of the insulator that passed by the protrusions revert back to their unstressed configuration, such that the insulator engages the protrusions 19 on all sides. As a result, when a rotational torque is applied to one of the connector components, the protrusions 19 engage the insulator material to prevent relative rotation between the insulator and the outer conductor.

Figure 8:
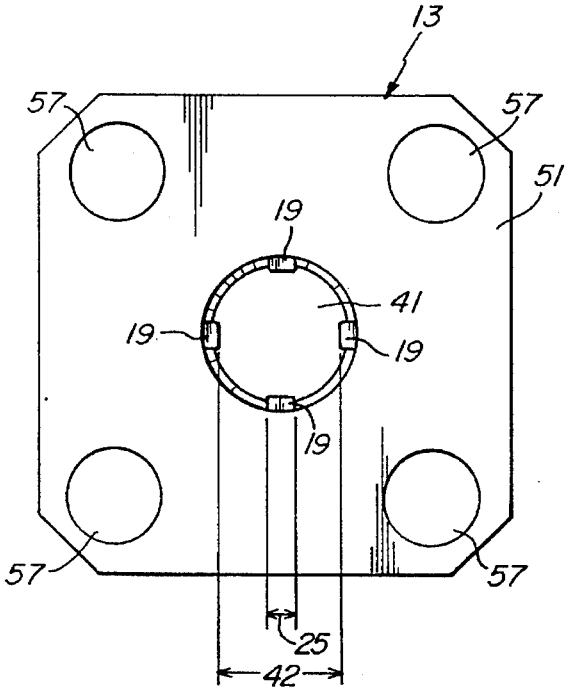
FIG. 8 is an end view of the staked end of an outer conductor of the present invention.

In one embodiment of the invention, the connector 10 is cylindrical, and its components have specific dimensions that are described below making reference to FIGS. 5–8. The outer conductor bore 41 has a minimum inner bore diameter 21 (FIG. 7) of 0.1474 inches. The outer conductor 13 includes four protrusions 19, as shown in FIG. 8, that each has a rectangular cross-section 23 (FIG. 6), with one side of the rectangle 23 being formed by a portion of the arc of the cylindrical outer conductor bore 41. Each protrusion has a length 25 of 0.030 inches, and a width 27 selected so that a distance 42 (FIG. 6) between protrusions 19 on opposing sides of the bore 41 is between 0.134 and 0.138 inches. As shown in FIG. 5, each protrusion 19 also has a depth 33 that corresponds to the amount of outer conductor material that must be displaced to create a protrusion 19 having the length 25 and width 27 described above. Thus, as shown in FIG. 6, each protrusion 19 takes up approximately 10–12 degrees of the 360 degrees that make up the circular perimeter 44 of the outer conductor's inner surface that defines the bore 41.

It has been found that the use of four protrusions 19 arranged symmetrically about the outer conductor and having the above-described dimensions, relative to the size of the connector 10, provides sufficient engagement between the outer conductor 15 and the insulator 17 to prevent rotation at torques of at least four ounce-inches. However, it should be understood that numerous other arrangements can alternatively be employed, wherein either a different number of protrusions are used, differently shaped or dimensioned protrusions are used, or both. All that is required is that the number and size of the protrusions be selected to prevent relative rotation between connector components at the specified torque for a particular application.

For example, a scaled-up version of the above-described embodiment can also be provided wherein each dimension of the connector 10 and each of the protrusions 19 is multiplied by a factor of two.

A factor in determining the size and shape of each protrusion 19 is that at least one corner 31 (FIG. 6) of the protrusion 19 should preferably be arranged so that it tends to cut into the insulator material as torque is applied to the insulator, to provide strong resistance. If the length 25 of a protrusion 19 is too large, the protrusion only engages the insulator 17 along its flat length 25 and the corners 31 do not cut into the insulator 17 as it is rotated. Therefore, the length 25 of a rectangular protrusion should not be made so large that the corners 31 do not cut into the insulator 17. In addition to the rectangular-shaped protrusions 19 used in the illustrative embodiment shown in the figures, protrusions in other shapes may also provide sufficient anti-rotational resistance. For example, the protrusions can have a cross-sectional shape that is square or triangular, each having at least one corner that cuts into the insulator as torque is applied to one of the connector components.

Another consideration in determining the dimensions of each protrusion 19 is the effect that their formation has on the electrical characteristics of the connector. It has been found that the formation of the protrusions 19 make the connector more capacitive. In accordance with the cylindrical embodiment of the present invention, it has also been found that the connector 10 becomes less capacitive as the diameter of the inner conductor 15 is decreased. Thus, in accordance with this embodiment, the diameter of the inner conductor 15 is decreased to counterbalance the capacitive effect of the protrusions 19. In this way, any electrical mismatch problems caused by the formation of the protrusions 19 are minimized. In addition, the depth 33 (FIG. 5) of each protrusion 19 should minimized because it has been found that electrical mismatch problems increase in proportion to the depth of the protrusions.

Figure 9:
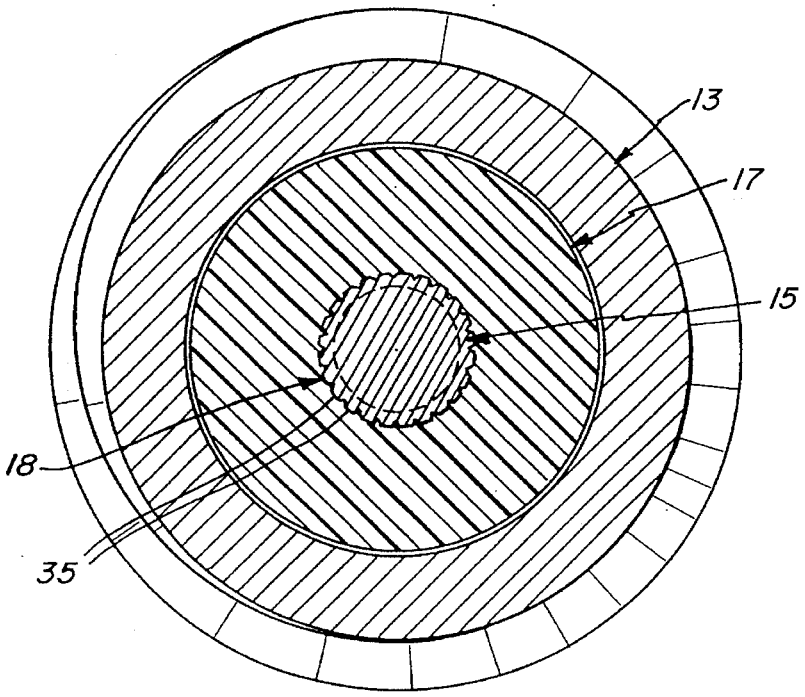
FIG. 9 is a cross-sectional view of an assembled connector of the present invention showing the engagement of the inner conductor knurls with the insulator.

In a preferred embodiment of the present invention, a means is also provided for preventing rotation of the inner conductor 15 relative to the insulating sleeve 17. As shown in FIGS. 3–4, the inner conductor 15 is provided with a plurality of knurls 18. FIG. 9 is a cross-sectional view of the connector through one of the two sets of knurls provided on the inner conductor. As seen from FIG. 9, the knurls 18 have raised areas 35 that extend into the insulator 17 material, which deforms about the raised areas. As a result, the insulator material engages the knurls on all sides and prevents rotation of the inner conductor relative to the insulator when torque is applied to the connector.

Figure 10:
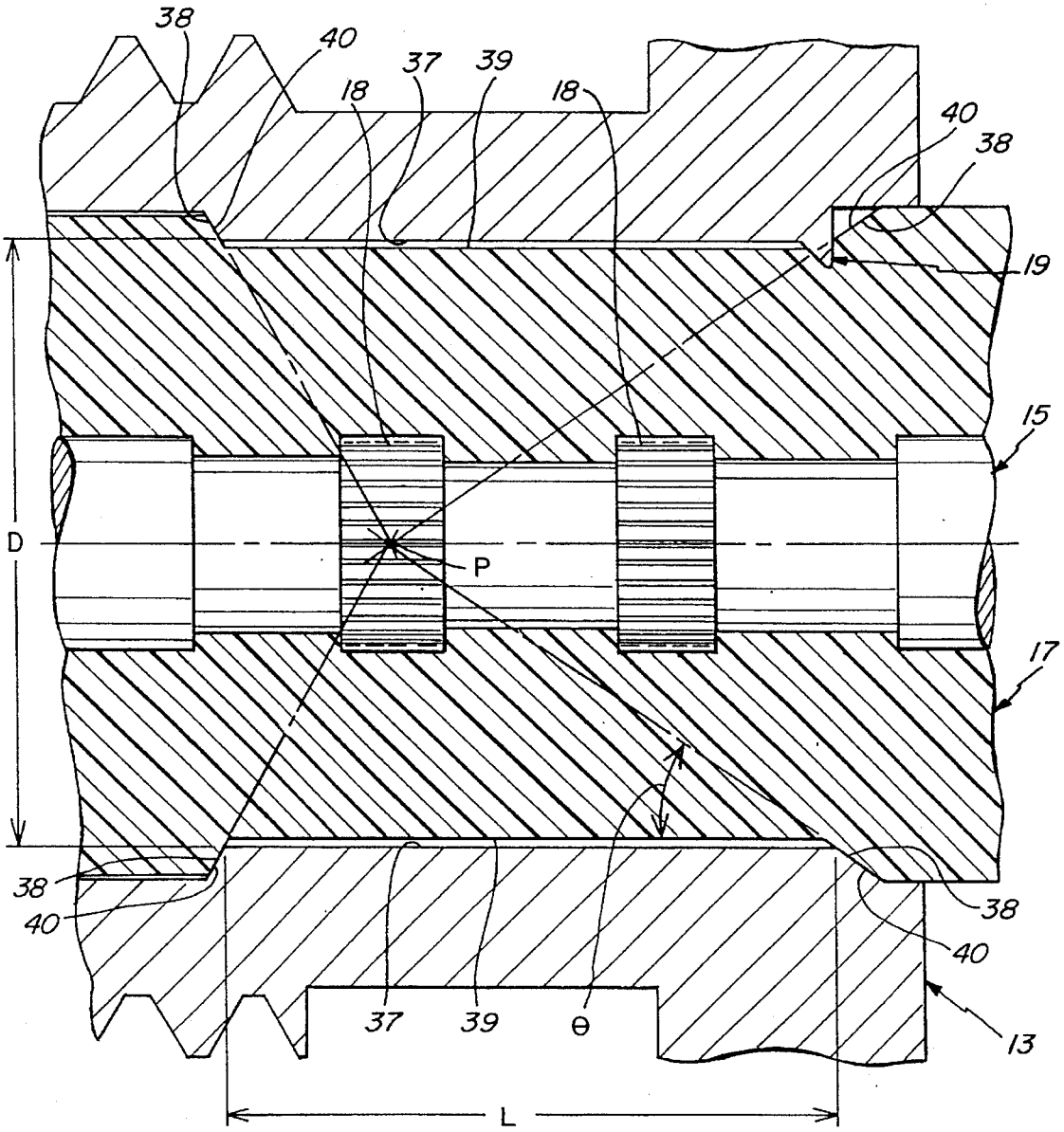
FIG. 10 is a longitudinal cross-sectional view of one embodiment of the present invention wherein the connector is constructed to ensure a rigid mechanical interconnecting relationship between its components over a wide temperature range.

In the specific embodiment of the present invention shown in the figures, the connector 10 is constructed using the techniques described in the '983 patent to ensure that it maintains a mechanically tight seal between the outer conductor 13 and the insulator 17 over wide temperature ranges. As shown in FIG. 10, the outer conductor 13 has an inwardly directed annular ridge 37 that is adapted to interlock with an annular recess 39 in the insulator 17. The respective edges 38 and 40 of the ridge and the insulator recess are each beveled at an angle 8 to a longitudinal axis of the connector. The length L of the ridge 37 is related to the diameter D of the insulator at each point along the slope of the beveled edges by the equation $L=D \tan \theta$. In a preferred embodiment, the angle $\theta$ equals 45° so that the length L of the ridge 37 substantially equals the diameter D of the insulator 17. Clearance is provided between the insulator 17 and the outer conductor 13 so as to enable expansion between the parts due to temperature changes. Contact is made between the insulator 17 and outer conductor 13 only at the beveled edges, which always stay in intimate but sliding contact over the temperature range at which the connector is used.

Although the connector has the above-described advantageous characteristic in a preferred embodiment, it should be understood that the anti-rotational features of the present invention can be employed with any electrical connector, including those that are not constructed in this manner.

Figure 11:
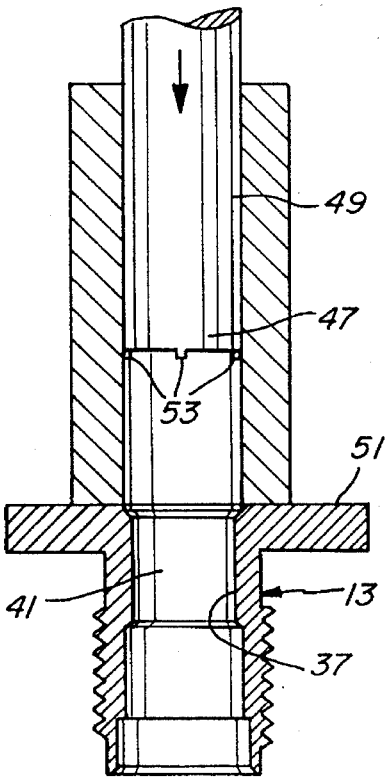
FIG. 11 illustrates one method of forming the protrusions in the outer conductor using a staking tool.

As stated above, the method of assembling the improved connector 10 of the present invention is similar in many respects to the method described in the '563 patent. However, the method of the present invention also includes a step of creating the protrusions 19 in the outer conductor 13. In one illustrative embodiment suggested in FIG. 11, the protrusions 19 are created by a staking tool 49 that has a tip 47 that is driven into a base end 51 of the outer conductor 13. The tip 47 has a plurality of stakes 53 that are arranged to correspond to the desired positions of the protrusions 19 on the base end 51 of the outer conductor. The stakes 53 are made of a material, such as steel or carbide, that is harder than the outer conductor 13 material. Thus, as the tip 47 is driven into the base end 51 of the outer conductor, each stake 53 displaces material from the smooth inner surface of outer conductor 13 to form a corresponding protrusion 19 that is integrally formed from the outer conductor. The depth of the protrusions is controlled by providing a stop (not shown) on the staking tool 49 to control its movement.

As shown in FIG. 8, in one embodiment of the invention the outer conductor is provided with a plurality of holes 57 that can each be used to receive a bolt or screw to hold the outer conductor in place. The holes 57 are formed by a machining tool (not shown) that drills the holes through the conductor material. In one embodiment of the invention, the machining tool and the staking tool are combined into a single machine so that the holes 57 and the protrusions 19 are formed simultaneously.

Figure 12:
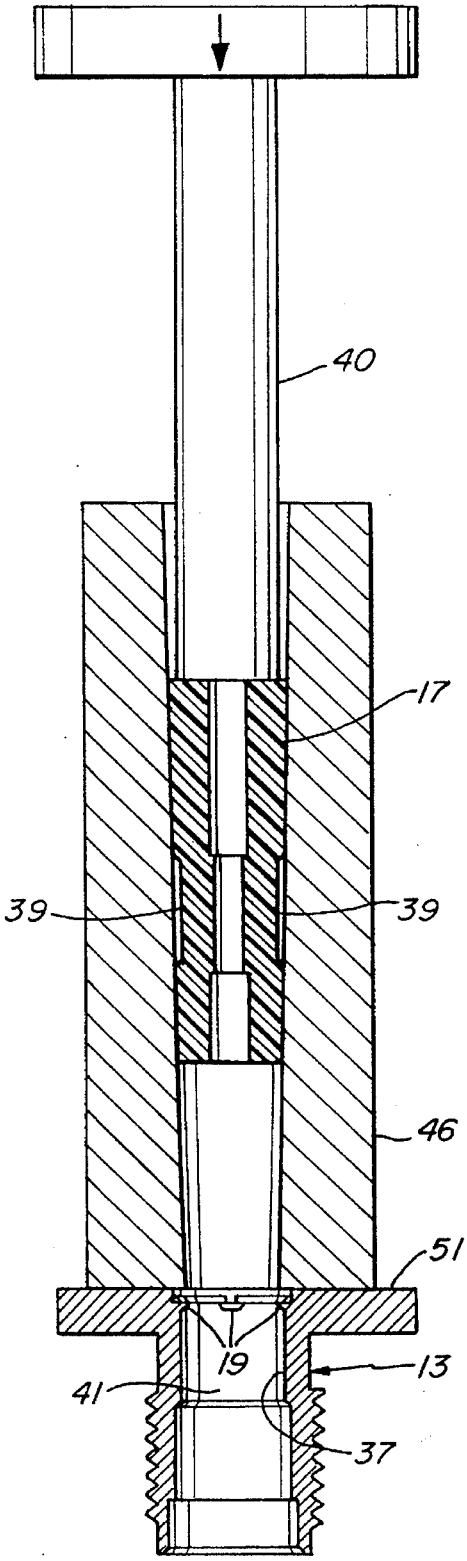
FIGS. 12 and 13 illustrate the assembly steps of inserting the insulator into the outer conductor.
Figure 13:
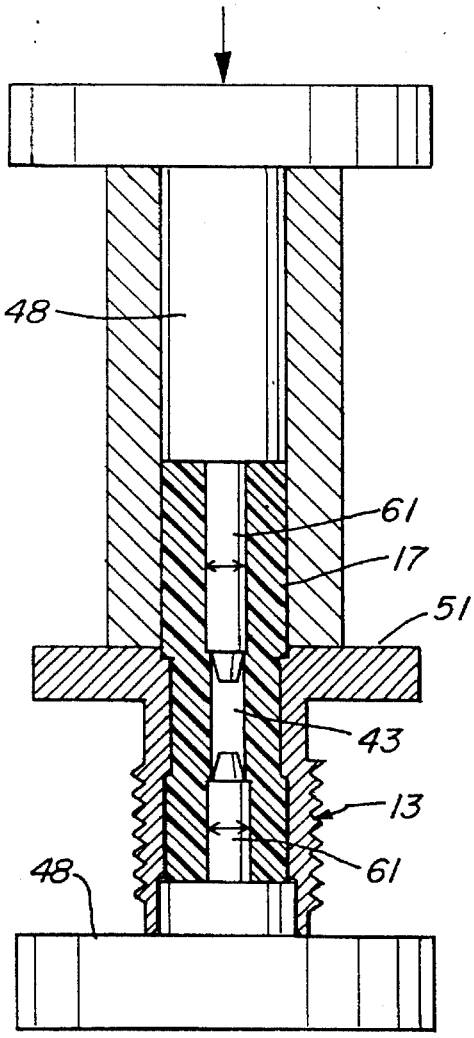
Figure 14:
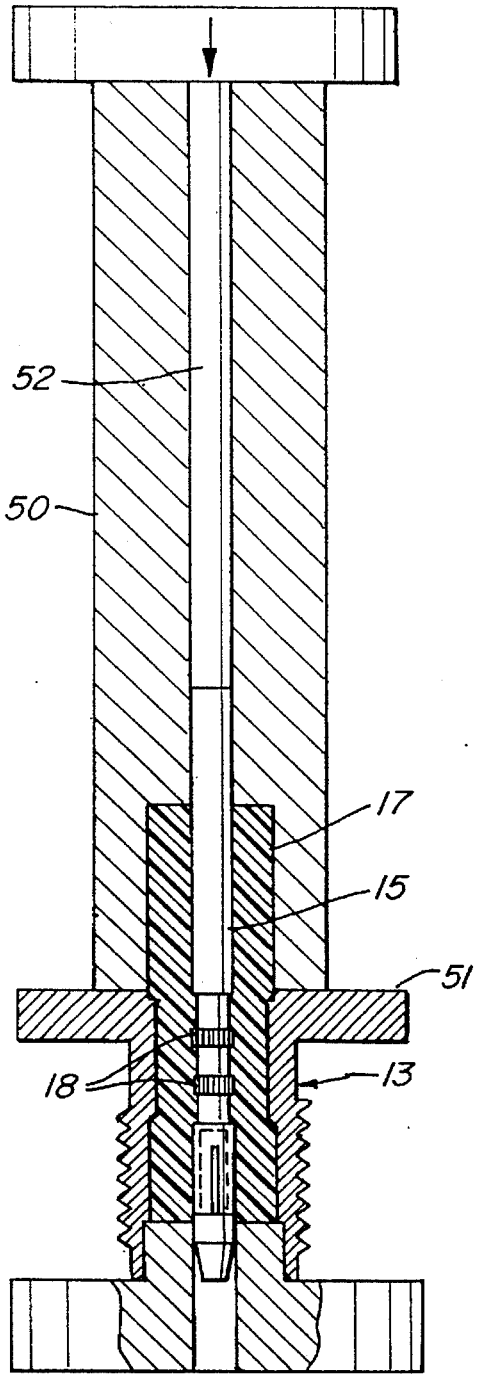
FIG. 14 illustrates the assembly step of inserting the inner conductor into the insulator.

Once the bore 41 and the protrusions 19 are formed in the outer conductor in the manner described above, the next step in the assembly method of the present invention is to insert the insulator 17 into the bore 41. In a preferred embodiment, the insulator 17 is inserted into the bore from the end of the outer conductor in which the protrusions are formed. As shown in FIGS. 12 and 13, a guide 46 and a pushing tool 40 are employed to compress the insulator 17 to a smaller diameter than in its unstressed state, so that it can more easily fit into the bore 41. Once the insulator 17 is pushed into the outer conductor bore 41, it is expanded using a pair of pushing tools 48. Each pushing tool 48 has a prong 61 that preferably has a stepped end and is sized to fit within the insulator bore 43. The prongs 61 assist in moving the insulator 17 back toward its unstressed configuration so as to provide an interlocking engagement between the insulator 17 and the outer conductor 13. Finally, the pushing tools 48 are withdrawn and, as shown in FIG. 14, the inner conductor is inserted into the insulator bore 43 using a guide 50 and a pushing tool 52. The insertion of the inner conductor also assists in radially expanding the insulator 17 and causing it to engage the outer conductor.

It should be understood that the foregoing description of the invention is intended merely to be illustrative thereof and that other embodiments, modifications and equivalents may be apparent to those skilled in the art without departing from its spirit.

What I claim is:

1. An electrical connector, comprising:

an outer conductor having a bore extending through at least a portion of its length, the outer conductor having an inner surface defining the bore, the outer conductor further having an annular ridge extending inwardly from the inner surface, the annular ridge having at least one beveled edge;

an insulator having a bore extending through at least a portion of its length, the insulator being at least partially disposed within the outer conductor bore, the insulator having an annular recess adapted to receive the annular ridge of the outer conductor, the annular recess having at least one beveled edge arranged to slidably engage the at least one beveled edge of the annular ridge of the outer conductor; and an inner conductor disposed at least partially within the insulator bore;

wherein the outer conductor includes at least one protrusion extending from the at least one beveled edge of the annular ridge, the at least one protrusion engaging the at least one beveled edge of the annular recess of the insulator to inhibit relative rotational movement between the insulator and the outer conductor.

2. The electrical connector claimed in claim 1 wherein said at least one protrusion is integrally formed from the outer conductor.

3. The electrical connector claimed in claim 1 wherein said at least one protrusion and said outer conductor are each formed from a same material.

4. The electrical connector claimed in claim 1 wherein said at least one protrusion is arranged to prevent relative rotational movement between the outer conductor and the insulator when a torque of up to 4 ounce/inches is applied to the inner conductor.

5. The electrical connector claimed in claim 1 wherein said inner conductor is provided with a plurality of raised surfaces that engage the insulator.

6. The electrical connector claimed in claim 1 wherein said at least one protrusion includes at least four protrusions that are arranged symmetrically about the outer conductor; and each of said at least four protrusions is integrally formed from the outer conductor.

7. The electrical connector claimed in claim 1, wherein:

the at least one beveled edge of the annular ridge includes first and second beveled edges disposed on opposing ends of the annular ridge; and the at least one beveled edge of the annular recess includes first and second beveled edges disposed on opposing ends of the annular recess.

8. The electrical connector claimed in claim 1 wherein said at least one protrusion includes at least one sharp corner.

9. The electrical connector claimed in claim 1 wherein said at least one protrusion includes at least two protrusions.

10. The electrical connector claimed in claim 9 wherein said at least two protrusions are arranged symmetrically about the outer conductor.

11. The electrical connector claimed in claim 1 wherein said at least one protrusion includes at least four protrusions.

12. The electrical connector claimed in claim 11 wherein said inner surface has a circular cross-section have a 360 degree circumference, and wherein each of said at least four protrusions consumes approximately 10 degrees of the circumference.

13. The electrical connector claimed in claim 1 wherein said outer conductor is formed from a first material and said insulator is formed from a second material, the first material being stronger than the second material.

14. The electrical connector claimed in claim 13 wherein said first material is stainless steel and said second material is polytetrafluoroethylene.

15. The electrical connector claimed in claim 13, wherein:

the at least one beveled edge of the annular ridge includes first and second beveled edges disposed on opposing ends of the annular ridge; and the at least one beveled edge of the annular recess includes first and second beveled edges disposed on opposing ends of the annular recess.

16. The electrical connector claimed in claim 1 wherein said at least one protrusion is integrally formed from the outer conductor; and said at least one protrusion includes at least one sharp corner.

17. The electrical connector claimed in claim 16 wherein said at least one sharp corner is arranged to cut into said insulator when a torque is applied to the insulator.

18. The electrical connector claimed in claim 17 wherein said at least one protrusion includes at least four protrusions that are arranged symmetrically about the outer conductor.

19. The electrical connector claimed in claim 1 wherein said at least one protrusion is integrally formed from the outer conductor; and wherein said outer conductor is formed from a first material and said insulator is formed from a second material, the first material being stronger than the second material.

20. The electrical connector claimed in claim 19 wherein said at least one protrusion includes at least one sharp corner.

21. The electrical connector claimed in claim 20 wherein said at least one sharp corner is arranged to cut into said insulator when a torque is applied to the insulator.

22. The electrical connector claimed in claim 21 wherein said at least one protrusion includes at least four protrusions that are arranged symmetrically about the outer conductor.

23. A connector, comprising:

an outer component having a bore extending through at least a portion of its length, the outer component having a surface defining the bore, the outer component further having an annular ridge extending inwardly from the surface, the annular ridge having at least one beveled edge; and an inner component being at least partially disposed within the outer component bore, the inner component having an annular recess adapted to receive the annular ridge of the outer component, the annular recess having at least one beveled edge arranged to slidably engage the at least one beveled edge of the annular ridge of the outer component;

wherein the outer component includes at least one protrusion extending from the at least one beveled edge of the annular ridge, the at least one protrusion engaging the at least one beveled edge of the annular recess of the inner component to inhibit relative rotational movement between the inner component and the outer component.

24. The electrical connector claimed in claim 23, wherein:

the at least one beveled edge of the annular ridge includes first and second beveled edges disposed on opposing ends of the annular ridge; and the at least one beveled edge of the annular recess includes first and second beveled edges disposed on opposing ends of the annular recess.

25. The electrical connector claimed in claim 23, wherein the outer conductor and the insulator engage only along the beveled edges of the annular ridge and the annular recess.

26. The electrical connector claimed in claim 23, wherein the connector has a longitudinal axis, the annular ridge has a length L measured in an axial direction to the longitudinal axis between spaced symmetric points at the first and second beveled edges of the annular ridge, the inner conductor has a mean diameter D measured in a normal direction to the longitudinal axis between spaced symmetric points along either of the first and second beveled edges of the annular recess, the annular recess has a length of substantially L, the beveled edges of the annular ridge and the annular recess being in contact at an angle θ measured from a plane normal to the longitudinal axis, the length L being related to the diameter D and angle θ irrespective of the relative coefficients of expansion of the outer conductor and the inner conductor by the following equation:

$$L=D \tan \theta.$$

27. The electrical connector claimed in claim 23, wherein the beveled edges are beveled at 45 degrees to a longitudinal axis of the electrical connector.

28. The electrical connector claimed in claim 27, wherein equals 45 degrees.

29. The electrical connector claimed in claim 23, wherein the outer conductor and the inner conductor each has a thermal coefficient of expansion, and wherein the beveled edges of the annular ridge and the beveled edges of the annular recess are constructed and arranged to engage with each other over a range of temperatures irrespective of the relative thermal coefficients of expansion of the outer conductor and the inner conductor.

30. The electrical connector claimed in claim 29, wherein the outer conductor and the insulator engage only along the beveled edges of the annular ridge and the annular recess.

31. The electrical connector claimed in claim 29, wherein the connector has a longitudinal axis, the annular ridge has a length L measured in an axial direction to the longitudinal axis between spaced symmetric points at the first and second beveled edges of the annular ridge, the inner conductor has a mean diameter D measured in a normal direction to the longitudinal axis between spaced symmetric points along either of the first and second beveled edges of the annular recess, the annular recess has a length of substantially L, the beveled edges of the annular ridge and the annular recess being in contact at an angle θ measured from a plane normal to the longitudinal axis, the length L being related to the diameter D and angle θ irrespective of the relative coefficients of expansion of the outer conductor and the inner conductor by the following equation:

$$L=D \tan \theta.$$

32. The electrical connector claimed in claim 29, wherein the beveled edges are beveled at 45 degrees to a longitudinal axis of the electrical connector.

33. The electrical connector claimed in claim 32, wherein θ equals 45 degrees.

34. The electrical connector claimed in claim 8 wherein said at least one sharp corner is arranged to cut into said insulator when a torque is applied to the insulator.

35. The electrical connector claimed in claim 11 wherein said at least four protrusions are arranged symmetrically about the outer conductor.

36. The electrical connector claimed in claim 29, wherein the outer conductor and the inner conductor each has a thermal coefficient of expansion, and wherein the beveled edges of the annular ridge and the beveled edges of the annular recess are constructed and arranged to engage with each other over a range of temperatures irrespective of the relative thermal coefficients of expansion of the outer conductor and the inner conductor.

37. The electrical connector claimed in claim 36, wherein the outer conductor and the insulator engage only along the beveled edges of the annular ridge and the annular recess.

38. The electrical connector claimed in claim 36, wherein the connector has a longitudinal axis, the annular ridge has a length L measured in an axial direction to the longitudinal axis between spaced symmetric points at the first and second beveled edges of the annular ridge, the inner conductor has a mean diameter D measured in a normal direction to the longitudinal axis between spaced symmetric points along either of the first and second beveled edges of the annular recess, the annular recess has a length of substantially L, the beveled edges of the annular ridge and the annular recess being in contact at an angle θ measured from a plane normal to the longitudinal axis, the length L being related to the diameter D and angle θ irrespective of the relative coefficients of expansion of the outer conductor and the inner conductor by the following equation:

$$L=D \tan \theta.$$

39. The electrical connector claimed in claim 36, wherein the outer conductor and the inner conductor each has a thermal coefficient of expansion, and wherein the beveled edges of the annular ridge and the beveled edges of the annular recess are constructed and arranged to engage with each other over a range of temperatures irrespective of the relative thermal coefficients of expansion of the outer conductor and the inner conductor.

40. The electrical connector claimed in claim 34, wherein:

the at least one beveled edge of the annular ridge includes first and second beveled edges disposed on opposing ends of the annular ridge; and the at least one beveled edge of the annular recess includes first and second beveled edges disposed on opposing ends of the annular recess.

41. The electrical connector claimed in claim 40, wherein the outer conductor and the insulator engage only along the beveled edges of the annular ridge and the annular recess.

42. The electrical connector claimed in claim 40, wherein the connector has a longitudinal axis, the annular ridge has a length L measured in an axial direction to the longitudinal axis between spaced symmetric points at the first and second beveled edges of the annular ridge, the inner conductor has a mean diameter D measured in a normal direction to the longitudinal axis between spaced symmetric points along either of the first and second beveled edges of the annular recess, the annular recess has a length of substantially L, the beveled edges of the annular ridge and the annular recess being in contact at an angle θ measured from a plane normal to the longitudinal axis, the length L being related to the diameter D and angle θ irrespective of the relative coefficients of expansion of the outer conductor and the inner conductor by the following equation:

$$L=D \tan \theta.$$

43. The electrical connector claimed in claim 40, wherein the outer conductor and the inner conductor each has a thermal coefficient of expansion, and wherein the beveled edges of the annular ridge and the beveled edges of the annular recess are constructed and arranged to engage with each other over a range of temperatures irrespective of the relative thermal coefficients of expansion of the outer conductor and the inner conductor.

44. The electrical connector claimed in claim 35, wherein:

the at least one beveled edge of the annular ridge includes first and second beveled edges disposed on opposing ends of the annular ridge; and the at least one beveled edge of the annular recess includes first and second beveled edges disposed on opposing ends of the annular recess.

45. The electrical connector claimed in claim 44, wherein the outer conductor and the insulator engage only along the beveled edges of the annular ridge and the annular recess.

46. The electrical connector claimed in claim 44, wherein the connector has a longitudinal axis, the annular ridge has a length L measured in an axial direction to the longitudinal axis between spaced symmetric points at the first and second beveled edges of the annular ridge, the inner conductor has a mean diameter D measured in a normal direction to the longitudinal axis between spaced symmetric points along either of the first and second beveled edges of the annular recess, the annular recess has a length of substantially L, the beveled edges of the annular ridge and the annular recess being in contact at an angle θ measured from a plane normal to the longitudinal axis, the length L being related to the diameter D and angle θ irrespective of the relative coefficients of expansion of the outer conductor and the inner conductor by the following equation:

$$L=D \tan \theta.$$

47. The electrical connector claimed in claim 44, wherein the outer conductor and the inner conductor each has a thermal coefficient of expansion, and wherein the beveled edges of the annular ridge and the beveled edges of the annular recess are constructed and arranged to engage with each other over a range of temperatures irrespective of the relative thermal coefficients of expansion of the outer conductor and the inner conductor.

* * * * *